US006802711B1

(12) United States Patent
Yrjänä et al.

(10) Patent No.: US 6,802,711 B1
(45) Date of Patent: Oct. 12, 2004

(54) APPARATUS FOR SUPPORTING MATERIAL TO BE TREATED IN CONTINUOUSLY OPERATED THERMAL TREATMENT FURNACES

(75) Inventors: Taisto Yrjänä , Tornio (FI); Heikki Arffman, Tornio (FI); Heikki Uurtamo, Tornio (FI); Risto Leinonen, Tornio (FI); Jussi Yli-Niemi, Tornio (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/049,153

(22) PCT Filed: Aug. 3, 2000

(86) PCT No.: PCT/FI00/00665

§ 371 (c)(1),
(2), (4) Date: Apr. 26, 2002

(87) PCT Pub. No.: WO01/11092

PCT Pub. Date: Feb. 15, 2001

(30) Foreign Application Priority Data

Aug. 4, 1999 (FI) ..... 19991668

(51) Int. Cl.[7] ..... F26B 13/18
(52) U.S. Cl. ..... 432/236; 432/8; 492/46
(58) Field of Search ..... 432/8, 59, 60, 432/228, 236; 219/469; 492/46; 248/200

(56) References Cited

U.S. PATENT DOCUMENTS

| | | | | |
|---|---|---|---|---|
| 4,049,372 | A | 9/1977 | Bloom | |
| 4,538,986 | A | 9/1985 | Blomqvist et al. | |
| 6,402,507 | B1 * | 6/2002 | Boettger | 432/236 |
| 6,471,509 | B2 * | 10/2002 | Ruiter | 432/59 |

FOREIGN PATENT DOCUMENTS

| | | |
|---|---|---|
| JP | 62256922 | 11/1987 |
| WO | 00/40766 | 7/2000 |

* cited by examiner

*Primary Examiner*—Gregory Wilson
(74) *Attorney, Agent, or Firm*—Smith-Hill and Bedell

(57) ABSTRACT

The invention relates to an apparatus for supporting material to be treated in continuously operated thermal treatment furnaces, where the supporting of the material is realized by means of support elements installed externally to the thermal treatment furnace, in the vicinity of the orifice of the furnace, said apparatus comprising at least two support elements that are installed movably, so that the mutual positions of the support elements can be adjusted by means of a drive arrangement of the support apparatus. According to the invention, in connection with the housing element used for supporting of the support elements, there is installed at least one gas flow control element which enables the flowing of the gas used for treating the material between the support element and the control element, said control element also constituting part of the sealing of the thermal treatment furnace.

24 Claims, 4 Drawing Sheets

APPARATUS FOR SUPPORTING MATERIAL TO BE TREATED IN CONTINUOUSLY OPERATED THERMAL TREATMENT FURNACES

The present invention relates to an apparatus for supporting the material to be treated in continuously operated thermal treatment furnaces, where the supporting of the material is realized by support elements external to the furnace.

From the FI patent 67,726, there is known a material support device to be used in thermal treatment furnaces, wherein on the circumference of a cooled roll, there are placed at least two cooled rolls with essentially smaller diameters. The larger roll, serving as the support device, is installed externally to the thermal treatment furnace, or between two successive thermal treatment furnaces, so that the supporting proper of the material is carried out by means of one circumferentially placed roll at a time. The roll located on the circumference of the larger roll rotates at the rotational velocity of the material to be supported, whereas the mutual position of the circumferentially installed rolls can be adjusted by means of an actuator arrangement connected to the larger roll.

From FIGS. 3 and 4 appended to the FI patent 67,726 it can be seen that the shape of the larger roll, which is formed to conform to the shape of the circumference of the smaller roll and arranged around it, prevents the flowing of gas essentially completely underneath the material to be supported. Thus the temperature of the supported material is at the bottom surface different than at the top surface. On the other hand, the purpose of the design of the larger roll specified in the FI patent 67,726 and illustrated in the drawing is to keep the smaller roll longer in operation by preventing the hot gases from proceeding to the surface of the smaller roll.

The object of the present invention is to eliminate some of the drawbacks of the prior art and to realize an advanced supporting apparatus for material to be treated in thermal treatment furnaces, by means of which apparatus hot gases are made to flow, at the support apparatus, also underneath the material to be supported, without subjecting the smaller roll used for the support proper to an excessive thermal load. The essential novel features of the invention are apparent from the appended claims.

SUMMARY OF THE INVENTION

The support apparatus according to the invention for material to be treated in continuously operated thermal treatment furnaces can advantageously be installed essentially near to the orifice of a continuously operated thermal treatment furnace, so that the support apparatus enables an unobstructed flowing of the gas employed in the treatment of the material to be supported, both above and underneath said material. Moreover, the support apparatus constitutes at least part of the thermal treatment furnace sealing. The support apparatus can also be advantageously installed for instance between two continuously operated thermal treatment furnaces, in which case the support apparatus forms part of the sealing of two successive thermal treatment furnaces.

According to the invention, the support apparatus of material to be treated in continuously operated thermal treatment furnaces comprises a housing element, against which at least one support element used for supporting the material is arranged to rest. Against the same housing element, there are advantageously supported two support elements which are installed symmetriccally with respect to the housing element. Moreover, the housing element is installed tumably with respect to the support elements, so that the mutual positions of the support elements can be exchanged by rotating the housing element around it axis. The housing element as such is installed essentially horizontally in the vicinity of the orifice of the continuously operated thermal treatment furnace, so that the housing element is advantageously supported by means of support members provided on both sides of the thermal treatment furnace orifice.

Advantageously the orifice of the thermal treatment furnace is formed of two essentially vertical walls that are interconnected by two essentially horizontal walls which are positioned on different levels. Around the housing element, at the vertical walls of the orifice, at each wall there is installed at least one sealing element, which in part seals the housing element against the thermal treatment furnace, when the support apparatus is in support position. In between the sealing elements providing for the sealing with the vertical walls of the orifice, in connection with the housing element there is installed, advantageously concentrically, one or several elements constituting the sealing together with the horizontal wall, which elements at the same time serve, underneath the material to be supported, advantageously as the control elements of the thermal treatment furnace gas flowing from one thermal treatment furnace to another. In case the number of thermal treatment furnace gas control elements is at least two, in the interval formed by each control element there is advantageously installed, around the housing element of the support apparatus, concentrically at least one intermediate support element. Advantageously the shape of the intermediate support element essentially conforms to the shape of the control element, but it is smaller than the control element, so that when seen from the end of the housing element of the support apparatus, the transversal area of the intermediate support element constitutes 70–90% of that of the respective control element. The intermediate support element can also be installed in the space left between the sealing element and the control element. Thus the intermediate support element can be used in the support apparatus according to the invention also when only one control element is installed around the housing element.

When the support apparatus according to the invention is in operating position, the support element of said apparatus, which advantageously is roller-shaped, supports the material to be supported that proceeds at an essentially high velocity past the support element, so that the support element rotates at an essentially equal velocity with the material to be supported. The control element, installed in connection with the housing element used for supporting the support element, controls the gas of the thermal treatment furnace, so that the gas can also flow underneath the material to be supported.

In order to prevent additional thermal load caused by gas flows on both sides of the support element, the support element is provided with a cooling agent lead-through, in which case there is obtained an essentially efficient heat transfer away from the support element. In heat transfer, there is advantageously used a flow-through type cooling agent circulation. Here the term flow-through type circulation means that the end where the cooling agent is discharged is different from the end where it is fed in. However, the flowing of the cooling agent in connection with the support element can include partial recirculation, in which case the passage of the cooling agent in some parts of the flow is opposite to the flow-through proper. Moreover, the sealing elements of the support element are provided with a lead-through type circulation of the cooling agent, in which case also the housing element of the support apparatus can be protected against an excessive thermal load.

In the support apparatus according to the invention, the sealing element and the control element installed around the housing element are advantageously made of some ceramic material, whereas the intermediate support element provided in between the two control elements is advantageously made of metal.

BRIEF DESCRIPTION OF THE DRAWINGS

The invention is explained in more detail with reference to the accompanying drawings, where.

Figure 1:
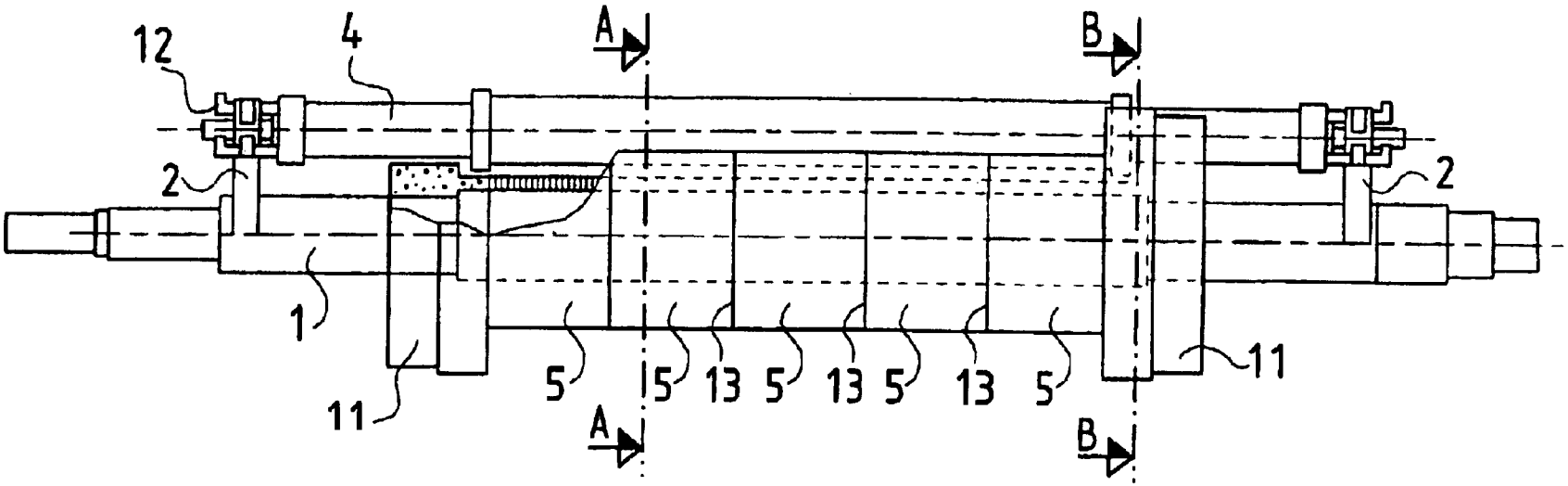
FIG. 1 is a side—view illustration of a preferred embodiment of the invention, seen in a partial cross-section.
Figure 2:
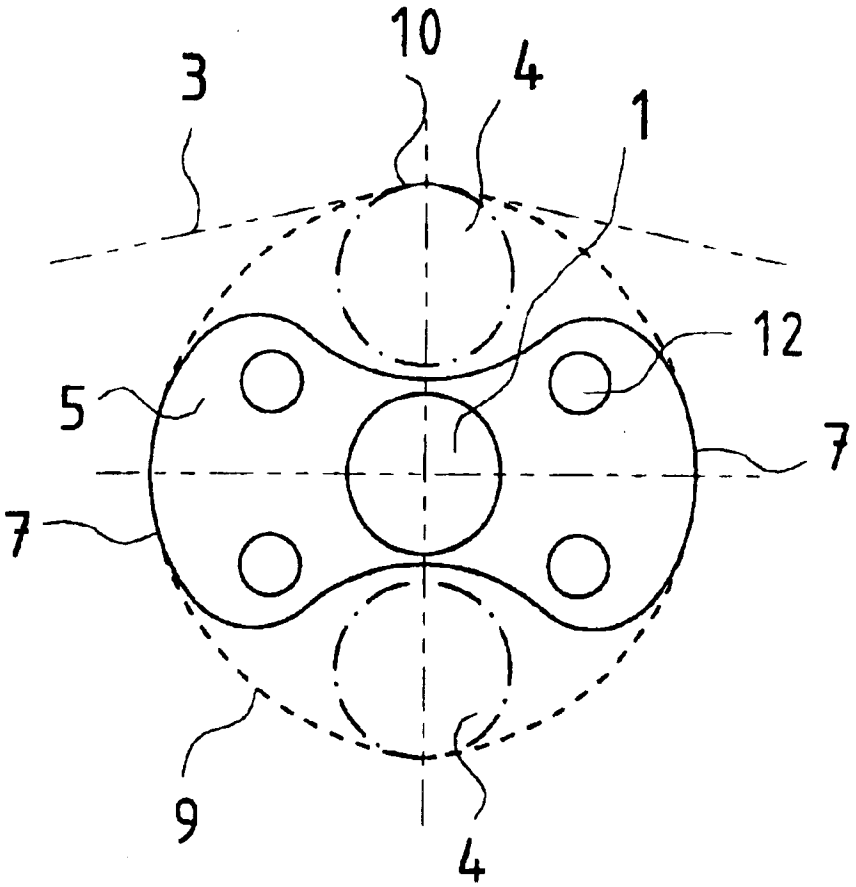
FIG. 2 is an illustration of the embodiment of FIG. 1, seen in the direction A—A.
Figure 3:
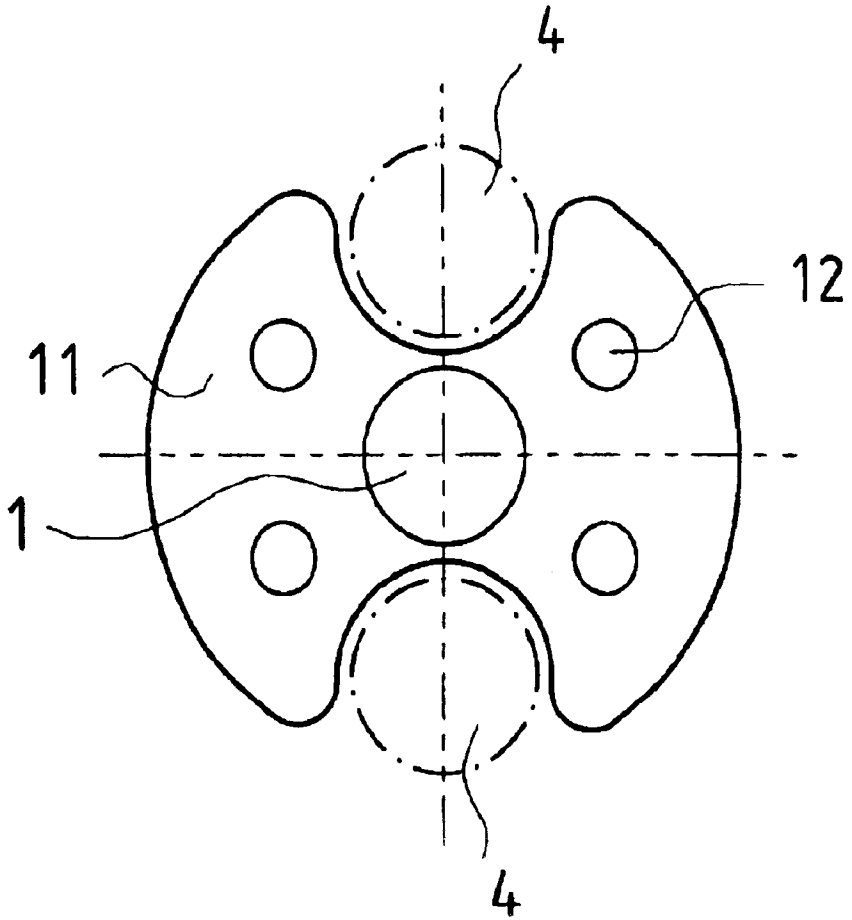
FIG. 3 is an illustration of the embodiment of FIG. 1, seen in the direction B—B.
Figure 4:
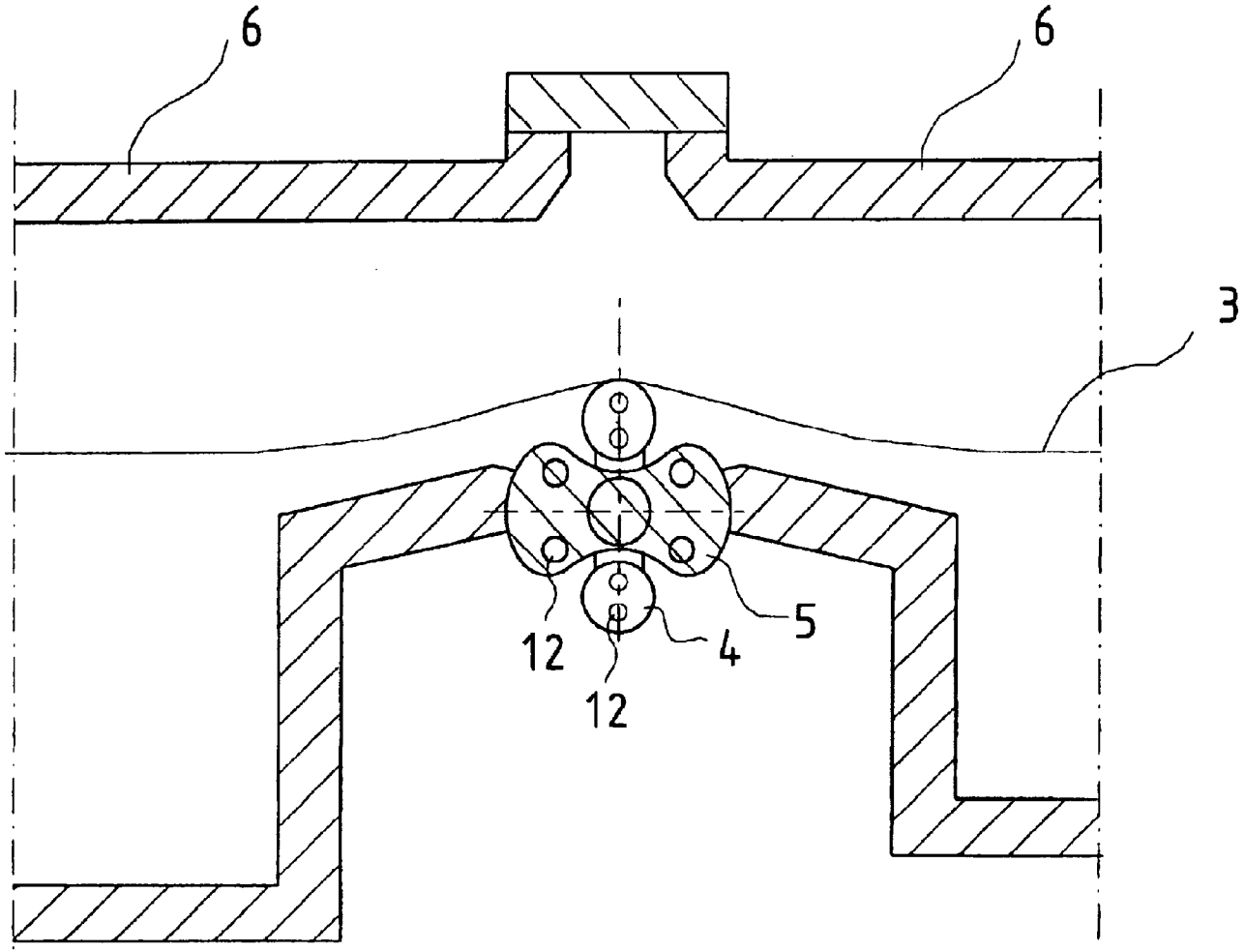
FIG. 4 is an illustration of the embodiment of FIG. 1, as installed at the orifice of a thermal treatment furnace.

According to the drawings, against the housing element 1 of the support apparatus according to the invention, there is supported, by means of support members 2, support rollers 4 meant for supporting the material 3 to be thermally treated. The support rollers 4 are installed symmetrically with respect to the housing element 1. In the housing element 1, there are connected members (not illustrated) in order to rotate the housing element, so that the mutual position of the support rollers 4 with respect to the housing element 1 can be changed.

Around the housing element 1, in the middle section thereof, there are installed gas flow control elements 5, which at the same time serve as part of the sealing of the thermal treatment furnace 6. In shape, the control element 5 is essentially symmetrical with respect to the housing element 1, so that the control element 5 is thinnest at the housing element 1. The control element 5 is located between the support rollers 4. The ends 7 of the control element 5 that deviate from the housing element 1 are designed so that the ends 7 form part of the circumference 9 at the same circle that also passes via the spot 10 of the support rollers 4 that is located farthest away from the housing elements 1. That section of the surface of the control element 5 that is located between the end 7 of the control element 5 and the housing element 1 advantageously provides curved guide surfaces that face towards the support rollers 4, in order to obtain an essentially unobstructed gas flow through the apertures formed between the support rollers 4 and the control element 5. Between the control elements 5, around the housing element 1, concentrically with the control elements 5, there are installed intermediate support elements 13, which in shape conform to the control elements, but in transversal area represent, when seen at the end of the housing element 1, about 80% of the measures of the control element 5.

Around the housing element 1, on both sides of the control element 5 and thus concentrically with respect to the control element 5, there are installed sealing elements 11, which on hand seal the apparatus according to the invention to the thermal treatment furnace 6, and on the other hand serve as a circulation guide to the gases flowing out of the thermal treatment furnace. The sealing elements 11 are installed, with respect to the thermal treatment furnace 6, so that the sealing elements 11 constitute sealing with the vertical walls of the orifice of the thermal treatment furnace 11. Further, the sealing elements 11 are shaped so that the sealing elements 11 prevent the gases from flowing essentially underneath the support rollers 4 and past them to the external surroundings of the thermal treatment furnace 6 and the support arrangement 1.

The housing element 1, the control element 5, the sealing element 11 and the intermediate support element 13, as well as the support roller 4 serving as the support element are provided with a flow-through type cooling agent circulation 12 in order to achieve an essentially efficient cooling.

What is claimed is:

1. A support apparatus for supporting material to be treated in a continuously operated thermal treatment furnace, said apparatus comprising:

an elongate gas control element having a central axis and having first and second guide surfaces, and first and second substantially cylindrical support elements of substantially equal diameter D and each having a central axis, the central axis of each support element being parallel to the central axis of the gas control element and being spaced at a distance S from the central axis of the gas control element, and the central axes of the control element and the support elements being disposed in a common plane, wherein the gas control element is located between the support elements with the first and second guide surfaces of the gas control element facing towards the first and second support elements respectively, the guide surfaces are spaced from the support elements to provide a gas flow channel between each support element and the gas control element, the gas control element includes two lobes that extend to opposite respective sides of said common plane, and each lobe extends radially from the central axis of the gas control element to a distance of at least (D/2+S).

2. An apparatus according to claim 1, wherein the gas flow channel increases in width with distance from the common plane.

3. An apparatus according to claim 1, wherein the first guide surface has a center of curvature that is farther than the central axis of the first support element from the central axis of the control element.

4. An apparatus according to claim 1, wherein each lobe of the gas control element has an outermost surface region at a distance R from the central axis of the support element.

5. An apparatus according to claim 4, wherein the diameter D of each support element is substantially equal to 2(R−S).

6. An apparatus according to claim 1, further comprising two sealing elements and wherein the gas control element is located between the two sealing elements.

7. An apparatus according to claim 6, comprising two intermediate support elements disposed between the gas control element and the sealing elements respectively.

8. An apparatus according to claim 6, wherein each sealing element is provided with a flow-through type cooling agent circulation.

9. An apparatus according to claim 1, wherein the gas control element is composed of at least two successive segments and the apparatus comprises an intermediate support element between the segments of the gas control element.

10. An apparatus according to claim 1, wherein the control element is curved over essentially its entire external surface.

11. An apparatus according to claim 1, wherein each support element is provided with a flow-through type cooling agent circulation.

12. An apparatus according to claim 1, wherein the control element is provided with a flow-through type cooling agent circulation.

13. A continuously operated thermal treatment furnace comprising support apparatus for supporting material to be treated in the furnace, said apparatus comprising:

an elongate gas control element having a central axis and having first and second guide surfaces, and first and second substantially cylindrical support elements of substantially equal diameter D and each having a central axis, the central axis of each support element being parallel to the central axis of the gas control element and being spaced at a distance S from the central axis of the gas control element, and the central axes of the control element and the support elements being disposed in a common plane, wherein the gas control element is located between the support elements with the first and second guide surfaces of the gas control element facing towards the first and second support elements respectively, the guide surfaces are spaced from the support elements to provide a gas flow channel between each support element and the gas control element and enable flow of gas used in treatment of the material between the support element and the control element, the gas control element includes two lobes that extend to opposite respective sides of said common plane, each lobe extends radially from the central axis of the gas control element to a distance of at least (D/2+S), and the gas control element constitutes part of a seal of the thermal treatment furnace.

14. A thermal treatment furnace according to claim 13, wherein the gas flow channel increases in width with distance from the common plane.

15. A thermal treatment furnace according to claim 13, wherein the first guide surface has a center of curvature that is farther than the central axis or the first support element from the central axis of the control element.

16. A thermal treatment furnace according to claim 13, wherein each lobe of the gas control element has an outermost surface region at a distance R from the central axis of the support element.

17. A thermal treatment furnace according to claim 13, wherein the diameter D of each cylinder support element is substantially equal to 2(R−S).

18. A thermal treatment furnace according to claim 13, wherein said support apparatus further comprises at least two sealing elements and the control element is installed between the two sealing elements so that the sealing elements direct gas flow underneath the material to be supported, between the support element and the control element.

19. A thermal treatment furnace according to claim 18, wherein the support apparatus comprises two interm diate support elements located between the control element and the sealing elements respectively.

20. A thermal treatment furnace according to claim 18, wherein each sealing element is provided with a flow-through type cooling agent circulation.

21. A thermal treatment furnace according to claim 13, wherein the gas control element is composed of at least two successive segments and the apparatus comprises an intermediate support element between the segments of the control element.

22. A thermal treatment furnace according to claim 13, wherein the control element is curved over essentially its entire external surface.

23. A thermal treatment furnace according to claim 13, wherein each support element is provided with a flow-through type cooling agent circulation.

24. A thermal treatment furnace according to claim 13, wherein the control element is provided with a flow-through type cooling agent circulation.

* * * * *